US005423633A

United States Patent [19]

Verstraeten

[11] Patent Number: 5,423,633

[45] Date of Patent: Jun. 13, 1995

[54] PILING APPARATUS ADAPTED TO BE PROVIDED IN A TUBE

[75] Inventor: Alexander J. Verstraeten, Knokke-Heist, Belgium

[73] Assignee: Beheersmaatschappij Verstraeten B.V., Oostburg, Netherlands

[21] Appl. No.: 173,803

[22] Filed: Dec. 23, 1993

[51] Int. Cl.[6] ..... E02D 7/00; E02D 7/14

[52] U.S. Cl. ..... 405/232; 405/228; 405/253; 405/255

[58] Field of Search ..... 405/240–243, 405/232, 251–254, 231, 228; 173/128, 131, 130, 132

[56] References Cited

U.S. PATENT DOCUMENTS

| | | | |
|---|---|---|---|
| 872,093 | 11/1907 | Stewart | 405/243 X |
| 1,830,651 | 11/1931 | Frankignoul | 405/242 |
| 1,979,599 | 11/1934 | Bald et al. | 405/253 X |
| 2,693,087 | 11/1954 | Quillinan | 405/253 |
| 2,926,500 | 3/1960 | Hoppe | 405/253 |
| 3,131,543 | 5/1964 | Dougherty | 405/253 X |

FOREIGN PATENT DOCUMENTS

| | | |
|---|---|---|
| 428382 | 7/1938 | Belgium . |
| 2034182 | 12/1970 | France . |
| 1634340 | 6/1970 | Germany . |
| 2105461 | 8/1972 | Germany . |
| 2655541 | 6/1978 | Germany . |
| 571637 | 9/1945 | United Kingdom . |

*Primary Examiner*—Dennis L. Taylor
*Attorney, Agent, or Firm*—Kenyon & Kenyon

[57] ABSTRACT

The invention relates to a piling apparatus for driving a tube (1) closed at the lower end by a base plate into the ground (6) to form a concrete foundation pile. The apparatus comprises a piling hammer with falling weight (4) and an impact cap (3) acting on the tube (1). The tube (1), at the lower end thereof in the vicinity of the base plate (6), is provided with an inwardly thickened edge (2), while the piling hammer (3,4,5) is provided within the tube (1) and has an impact cap (3) resting in a centered position on both the thickened edge (2) and the bottom plate (6), said piling hammer (3,4,5) comprising a self-centring guide device (9,10,11) acting on the inner surface of the tube (1).

6 Claims, 4 Drawing Sheets

PILING APPARATUS ADAPTED TO BE PROVIDED IN A TUBE

This invention relates to a piling apparatus for driving a tube closed at the lower end by a base plate into the ground to form a concrete foundation pile, which apparatus comprises a piling hammer with falling weight and an impact cap acting on the tube.

Such a piling apparatus has been known from practice for many years. The piling hammer is positioned on the upper edge of the tube and the tube is driven into the ground to reach the desired depth by means of a falling weight which is controllable in vertical direction. Subsequently, a reinforcement is provided in the tube and the tube is filled with concrete, after which the tube is withdrawn from the ground under vibration, using a vibrator.

This method for manufacturing concrete foundation piles has proved to be highly reliable in a technical sense. Objections to this method have been raised on account of the fact that noise pollution is caused during piling, which amply exceeds the limits of environmental legislation, which is becoming more and more stringent. When piling blows are applied to the head of the tube, this tube will act as a resonance box, causing a sound emission that is environmentally unacceptable.

The object of the present invention is to provide a piling apparatus which, in operation, has a substantially lower sound emission remaining below the maximum sound level allowed by law, so that the piling apparatus can also be used in densely populated areas.

According to the invention, this object is realized by providing a piling apparatus of the above-described type, with the tube, at the lower end thereof in the vicinity of the base plate, being provided with an inwardly thickened edge, while the piling hammer is provided within the tube and has an impact cap resting in a centred position on both the thickened edge and the bottom plate, which piling hammer comprises a self-centring guide device acting on the inner surface of the tube.

A further analysis of the piling process teaches that 80% of the piling energy is required for overcoming the point resistance of the tube which is closed at the lower end, and 20% for overcoming the friction of the tube surface in the soil. By transmitting this 80% of the piling energy directly to the bottom plate and only 20% to the tube wall, the piling tube may be of a considerably thinner and lighter design than in the case where a piling apparatus acts on the upper, end of the tube. Moreover, the noise-producing source, i.e. the falling weight, disappears below the ground level and only 20% of the piling energy is delivered to the tube, so that a considerably lower sound emission to the environment takes place.

The self-centring guide device of the piling hammer ensures that the piling energy is always transmitted centrically to the impact cap, also if the tube is to be driven into the ground not truly vertically but at an oblique angle.

Preferably, the thickened edge at the lower end of the tube has a trapezoidal section. The diverging portion of this thickened edge facilitates the out-flow of concrete when the tube is being withdrawn from the ground and has a compacting effect on the concrete located under the thickened edge during the up-and-down tube movement when the tube is being withdrawn.

To ensure that the impact cap rests both on the thickened edge at the lower end of the tube and on the bottom plate, preferably a slightly compressible ring is provided between the bottom plate and the end portion of the tube proximal to that bottom plate.

Embodiments of the piling apparatus according to the invention will be described in more detail with reference to the accompanying drawings. In these drawings.

Figure 1:
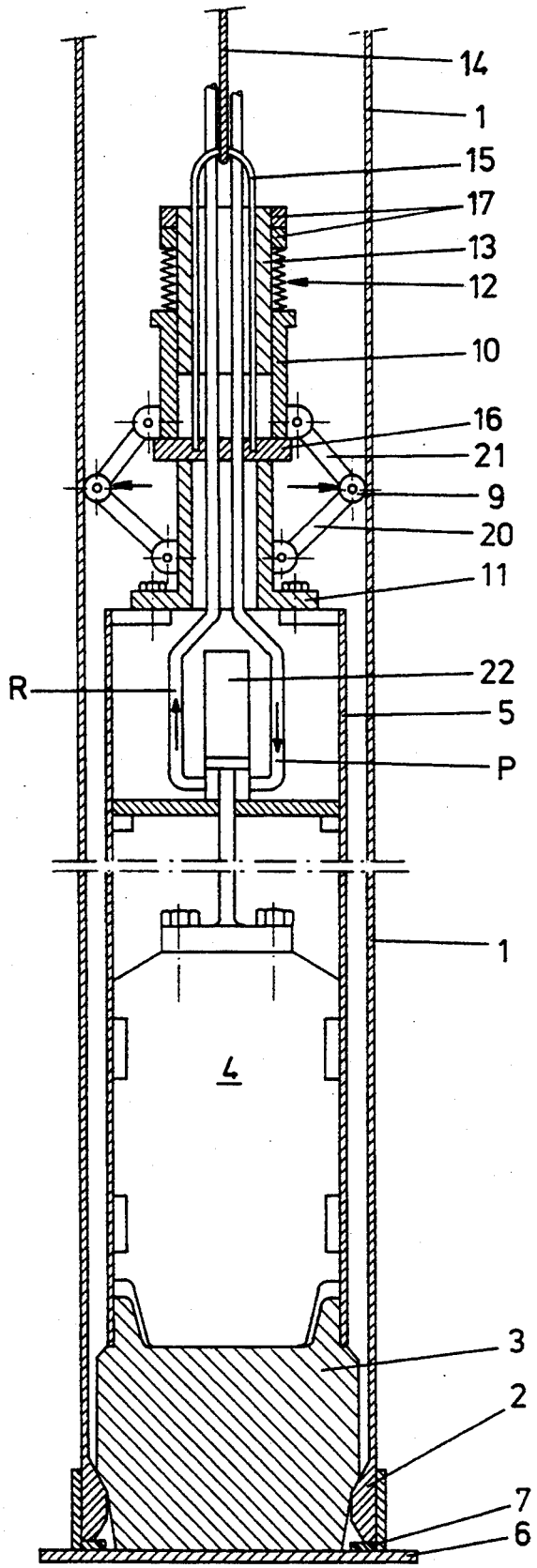
FIG. 1 shows the piling hammer according to the invention in a first embodiment.
Figure 2:
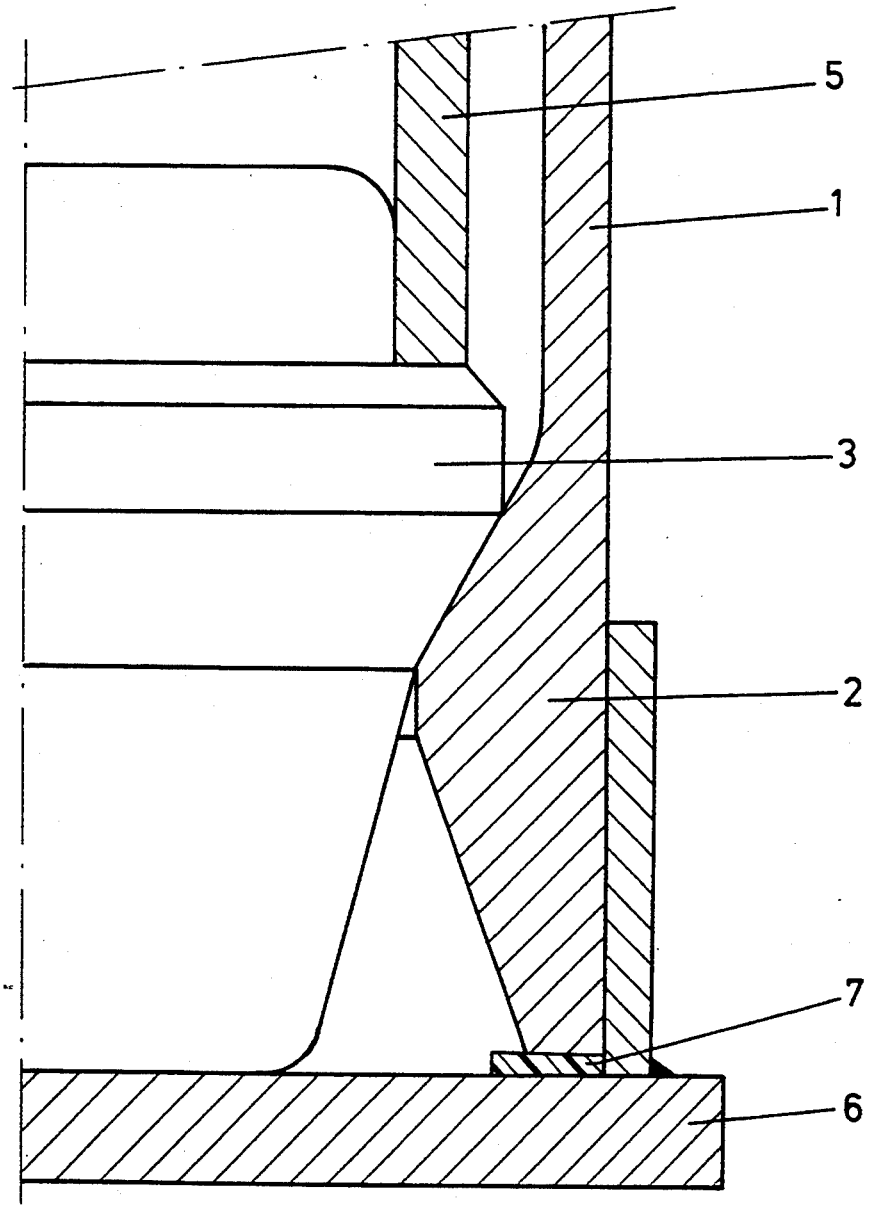
FIG. 2 shows—to an enlarged scale—the shape of the lower end of the tube with associated impact cap.

FIG. 1 shows a piling tube 1, provided, at the lower end thereof, with a base plate 6 closing the piling tube 1, which base plate 6 is fitted loosely over the lower edge of the piling tube 1. At the lower end, the piling tube 1 is provided with an inwardly thickened edge 2 of trapezoidal section. A complementarily shaped impact cap 3 rests on the converging portion of this edge 2, which impact cap 3 further has a conical shape and rests by its lower face on the bottom of the base plate 6. Located between the base plate 6 and the end portion of the tube 1 proximal to the base plate is a slightly compressible ring 7, ensuring that the impact cap 3 rests both on the converging portion of the thickened edge 2 and on the bottom of the base plate 6. By way of illustration, this is shown to an enlarged scale in FIG. 2.

In addition to the impact cap 3, the internal piling hammer comprises a guide tube 5 connected to the upper edge of the impact cap 3, which guide tube 5 accommodates a falling weight 4, slidable in vertical direction. At the upper end of the guide tube 5 a self-centring guide device is provided comprising a guide bush 11 connected to the guide tube 5, extending in upward direction and having, at the end portion thereof, a threaded part 13 on which a nut/lock nut 17 is provided. A slide sleeve 10 can be slid over the guide: bush 11, which slide sleeve 10, at the upper end thereof, abuts against a spring 12, whose other end portion abuts against the nut/lock nut 17. Consequently, the spring 12 presses the slide sleeve in downward direction. Located at the lower end of the slide sleeve 10 is a ring 16, also slidable over the guide bush 11 and to which a hair pin-shaped element 15 is connected, to which hair-pin shaped element a hoist cable 14 is attached.

On the outer surface of the guide bush 11 a set of arms 20 are mounted, evenly distributed along the circumference and pivotally connected to the guide bush 11. These arms 20 carry rollers 9, at the other end pivotally connected to the slide sleeve 10 via arms 21. When cables 14 are slack, the slide sleeve 10 is pressed in downward direction by the spring 12, as a result of which the rollers 9 will under pressure abut against the inner wall of the piling tube 1. The spring 12 should be dimensioned such that the outward forces acting on the rollers 9 are greater than the laterally directed component of the weight of the piling hammer when the piling tube 1 is oblique, so that in that case, too, the play a between piling tube 1 and guide bush 5 remains present and the piling hammer is in a centred position in the piling tube 1.

Located within the guide tube 5 is a piston/cylinder combination 22 for operating the falling weight 4, capable of being displaced in upward direction over, for instance, 1 meter and of subsequently falling freely on the impact cap 3. The piston/cylinder combination 22 is connected to a pressure line P and also to a return line R. Obviously, the falling weight 4 can also be displaced in upward direction in a different manner.

When the piling hammer is placed into the piling tube 1, it is centred at the lower end thereof by the conical shape of the impact cap 3 and at the upper end thereof by the outwardly pressed rollers 9 which abut against the inner wall of the piling tube 1. When the rope 14 is pulled for removing the piling hammer from the piling tube 1, the slide sleeve 10 is slid in upward direction over the guide bush 11 by the ring 16, whereby the rollers 9 are released from the inner wall of the piling tube 1. This facilitates the removal of the piling hammer from the piling tube 1 considerably.

Figure 3:
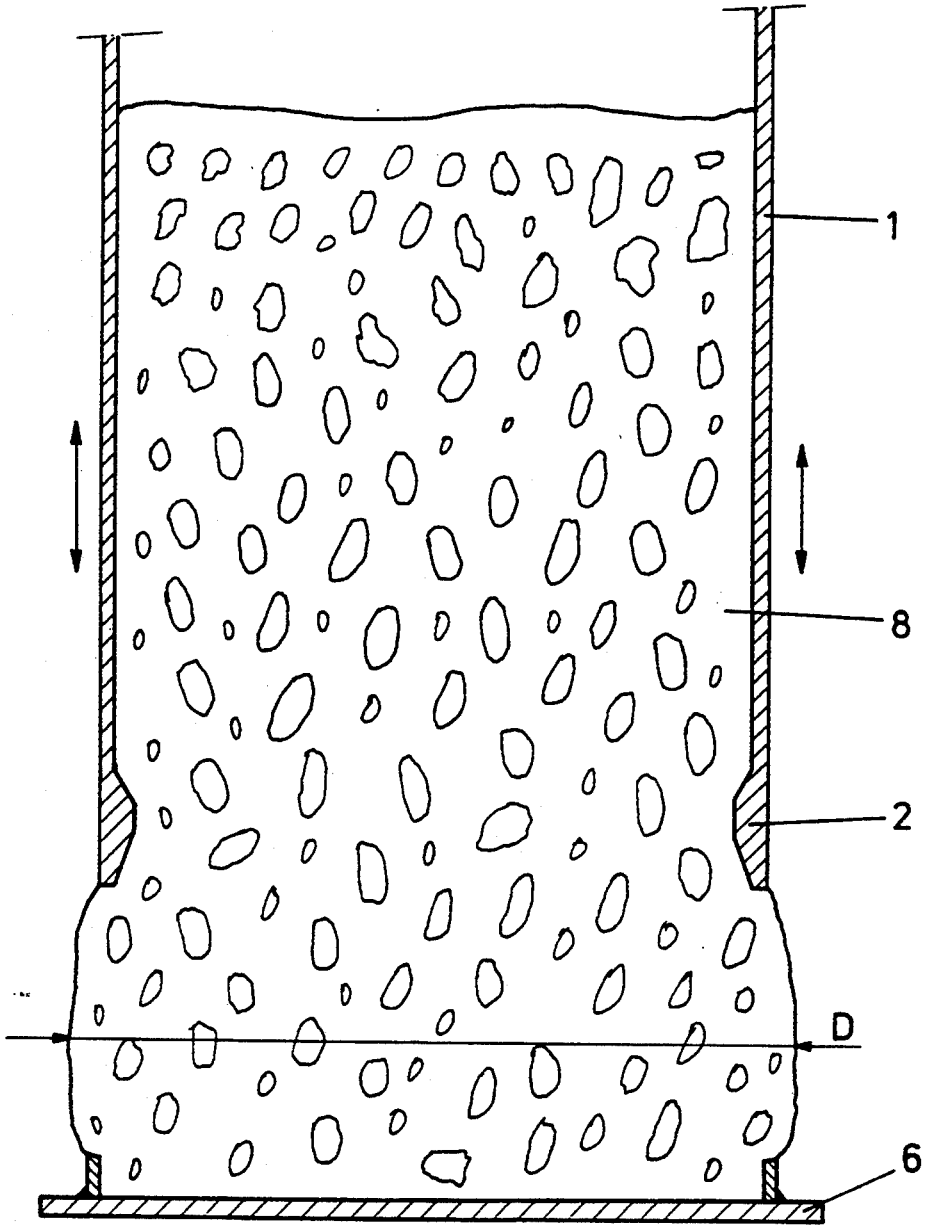
FIG. 3 shows the tube being withdrawn from the ground after concrete has been poured.

After the piling tube 1 has been brought to a sufficient depth by means of the internal piling hammer, for instance 20 meters below the ground level, the piling hammer is removed from the piling tube 1 as indicated above and the piling tube 1 can internally be provided with a reinforcement, after which the tube can be filled with concrete. Removal of the tube takes place by means of a vibrator, schematically shown in FIG. 3, which is clamped around the upper end of the tube and is capable of bringing the piling tube 1 into a vertically directed oscillating movement. In this connection, it is important that the outflow of concrete 8 at the lower end of the tube is not obstructed by the thickened edge 2. The diverging shape of this edge 2 facilitates the outflow of the concrete 8 and avoids the formation of a constriction in the concrete foundation pile, which in this manner acquires a diameter D which is at least equal to the diameter of the piling tube. Via the thickened edge 2, the oscillating movement of the piling tube 1, effected by the vibrator, provides a thrust action on the concrete 8 that has already left the piling tube 1.

Figure 4:
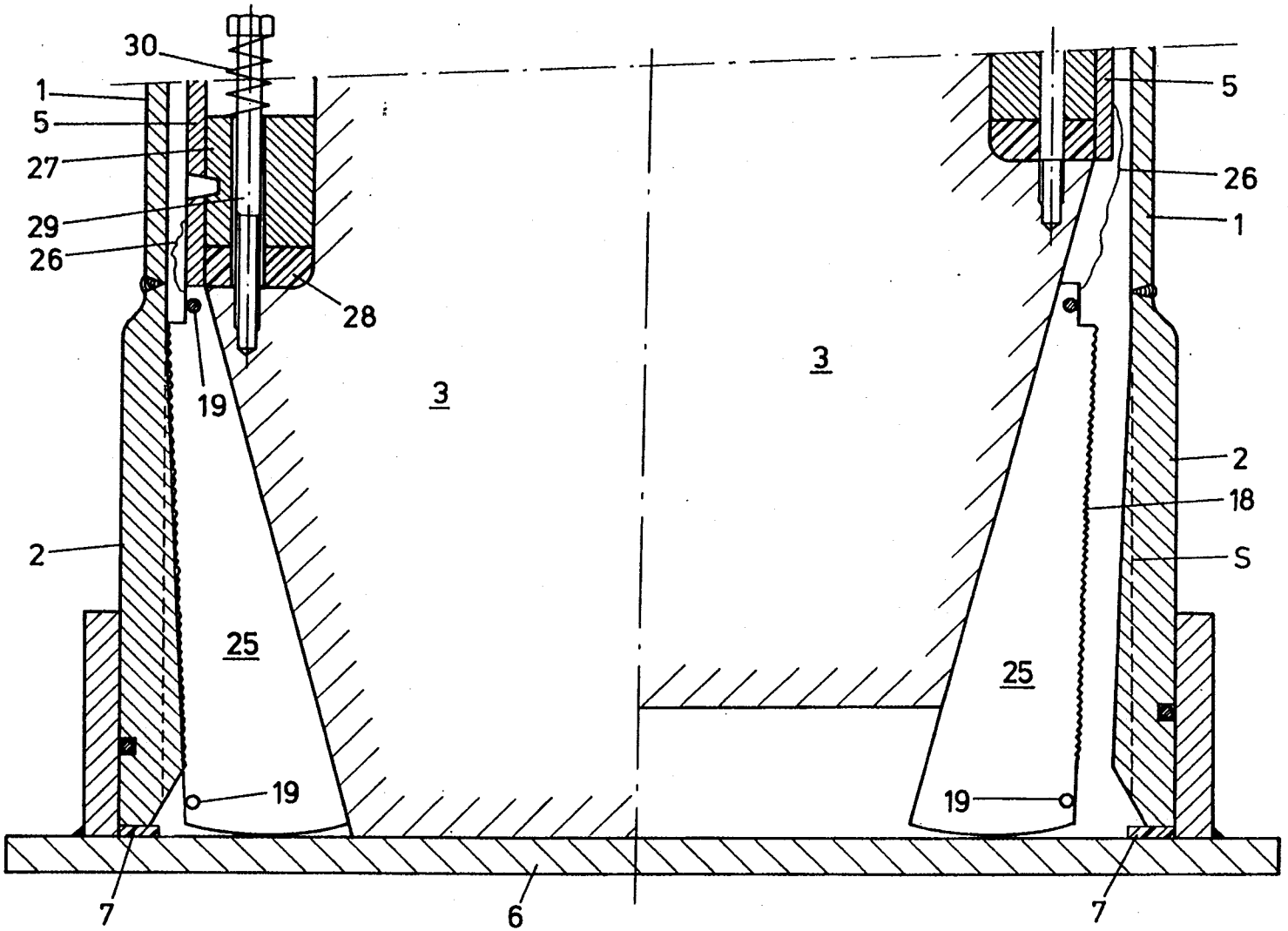
FIG. 4 shows a second embodiment of the piling apparatus according to the invention, wherein the position of the impact cap during piling is shown in the left-hand section and the position thereof during withdrawal of the piling hammer from the tube is shown in the right-hand section.

FIG. 4 shows a second embodiment of the apparatus according to the invention. This second embodiment mainly differs from the embodiment shown in FIG. 1 by a different design of the impact cap 3 and the thickened edge of the piling tube 2. In this second embodiment the thickened edge 2 is of a slightly conical design, as indicated by the dotted line S in FIG. 4, indicating the extension of the inner wall of the piling tube 1. The impact cap 3 is of conical design and between the outer wall of the impact cap 3 and the thickened edge 2 a set of wedge-shaped segments 25 are provided, evenly distributed along the circumference of the impact cap 3. The piling energy is transmitted via the impact cap 3 to the base plate 6 and via the wedge-shaped segments 25 to the edge 2 of the piling tube 1. The segments 25 abut by the outwardly directed teeth thereof against the slightly conical inner face of the thickened edge 2. The segments 25 are coupled to each other by means of two circular springs 19, arranged at the upper and lower ends of the segments 25. These springs 19 keep the segments 25 pressed against the wall of the impact cap 3. In order to obtain a proper connection with the edge 2 of the piling tube 1, the outwardly directed edges 18 of the wedge-shaped segments 25 are provided with a rough, hardened surface.

FIG. 4 further shows a conventional coupling between the guide tube 5 for the falling weight 4 and the impact cap 3. The tube 5, at the lower end thereof, is provided with a ring 27, fixedly connected to the tube 5. The upper end of the impact cap 3 is provided with a head of a diameter which is approximately equal to the inner diameter of the ring 27. Positioned between the ring 27 and the impact cap 3 is a shock-damping ring 28, made of rubber. A series of bolts 29, comprising springs 30, connect the tube 5 to the impact cap 3.

When the falling weight 4 strikes the impact cap 3, the impact cap 3 can move in downward direction relative to the end portion of the tube 5, after which the tube 5 falls on the impact cap 3 with some delay. When the piling hammer is removed from the piling tube 1, the tube 5 is first displaced in upward direction and subsequently the impact cap 3 is taken along via the bolts 29. At their upper ends, the wedge-shaped segments are connected to the tube 5 via thin cables and can consequently be taken along as well after the impact cap 3 has been displaced upwards over some distance and the segments 25 have moved radially inwards under the influence of the circular springs 19.

I claim:

1. A piling apparatus for driving a tube closed at the lower end by a base plate into the ground to form a concrete foundation pile, which apparatus comprises a piling hammer with falling weight and an impact cap acting on the tube, characterized in that the tube (1), at the lower end thereof in the vicinity of the base plate (6), is provided with an inwardly thickened edge (2), while the piling hammer (3, 4, 5) is provided within the tube and has an impact cap (3) resting in a centred position on both the thickened edge (2) and the base plate (6), said piling hammer (3, 4, 5) comprising a self-centring guide device (9, 10, 11) acting on the inner surface of the tube (1).

2. A piling apparatus according to claim 1, characterized in that the thickened edge (2) has a trapezoidal section.

3. A piling apparatus according to claim 1, characterized in that the thickened edge (2) is of a slightly conical design, while between the conical impact cap (3) and the thickened edge (2) a set of wedge-shaped segments (25) are provided, evenly distributed along the circumference, for transmitting the piling energy produced by the falling weight (4) to the base plate (6) and the thickened edge (2) of the tube (1).

4. A piling apparatus according to claim 1, characterized in that between the base plate (6) and the end portion of the tube (1) proximal to the base plate (6) a slightly compressible ring (7) is provided.

5. A piling apparatus according to claim 1, characterized in that the self-centering guide device (9, 10, 11) comprises a guide bush (11) mounted on the upper end of the guide tube (5) for the falling weight (4), over which a slide sleeve (10) is slidable under spring pressure (12), while, further, a set of guide rollers (9) are present, connected to the tube (11) and the sleeve (10) via pivotable arms (20, 21), each of said guide rollers (9) being capable of being pressed radially outwards against the inner wall of the tube (1) by the spring pressure (12) exerted on the sleeve (10).

6. An apparatus according to claim 3, characterized in that the wedge-shaped segments (25) are pressed against the conical impact cap (3) by means of at least two circular springs (19) and suspended from the guide tube (5) of the piling hammer (3, 4, 5), while the radially outwardly directed edges (18) of the wedge-shaped segments (25) are provided with a rough, hardened surface.

* * * * *